US006109853A

United States Patent [19]

Paulmichl

[11] Patent Number: 6,109,853

[45] **Date of Patent: *Aug. 29, 2000**

[54] MECHANICAL AUTOMOBILE PARKING FACILITY

[76] Inventor: Dieter Paulmichl, DE-7970 Leutkirch 4, Gebrazhofen, Germany

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 07/807,849

[22] Filed: Jul. 29, 1991

[51] Int. Cl.[7] ..... E04H 6/12

[52] U.S. Cl. ..... 414/239; 414/241; 414/260; 414/264

[58] Field of Search ..... 414/233–5, 239–41, 414/245–6, 253, 269–60, 264

[56] References Cited

U.S. PATENT DOCUMENTS

| | | | |
|---|---|---|---|
| 1,800,079 | 4/1931 | Johnston | 414/264 |
| 2,826,312 | 3/1958 | Francis | 414/240 |
| 2,876,913 | 3/1959 | Roth et al. | 414/523 |
| 3,079,015 | 2/1963 | Sinclair . | |
| 3,451,564 | 6/1969 | Haas . | |
| 3,710,957 | 1/1973 | Small | 414/253 X |
| 3,856,160 | 12/1974 | Roth | 414/259 X |
| 4,166,546 | 9/1979 | English | 414/246 X |
| 4,170,310 | 10/1979 | Bajulaz | 414/241 |
| 4,264,257 | 4/1981 | Saurwein | 414/259 |
| 4,307,985 | 12/1981 | Desprez et al. | 414/234 X |
| 4,337,013 | 6/1982 | Buttironi | 414/240 |
| 4,986,714 | 1/1991 | Fernström | 414/264 X |
| 5,013,203 | 5/1991 | Wakabayashi | 414/234 X |
| 5,098,246 | 3/1992 | Jung | 414/264 X |
| 5,238,348 | 8/1993 | Reimer | 414/264 X |

FOREIGN PATENT DOCUMENTS

| | | | |
|---|---|---|---|
| 254064 | 3/1967 | Austria . | |
| 337514 | 10/1989 | European Pat. Off. . | |
| 0351374 | 1/1990 | European Pat. Off. | 414/246 |
| 2645572 | 10/1990 | France | 414/259 |
| 1196349 | 7/1965 | Germany . | |
| 2404057 | 7/1975 | Germany . | |
| 2541347 | 3/1977 | Germany . | |
| 3740586 | 7/1983 | Germany . | |
| 3212822 | 10/1983 | Germany . | |
| 178679 | 7/1989 | Japan | 414/234 |
| 207573 | 8/1989 | Japan | 414/234 |
| 219263 | 9/1989 | Japan | 414/235 |
| 88/04107 | 7/1986 | WIPO | 414/253 |
| 87/01685 | 3/1987 | WIPO . | |
| 89/04900 | 6/1989 | WIPO . | |

*Primary Examiner*—James W. Keenan
*Attorney, Agent, or Firm*—Brown, Martin, Haller & McClain, LLP

[57] ABSTRACT

A mechanical automobile parking facility with auto parking pallets, in which a vehicle is driven onto an auto parking pallet which is moved with the vehicle thereon to a predetermined space inside the facility. In order to guarantee reliable and abrasion free parking, a driving unit on rails is included whereby the driving unit with the auto parking pallet lying thereon, proceeds along a parking aisle and the auto parking pallet is pushed sideways from the driving unit by telescopic cylinders over glide rails into a free parking space, or conversely the auto parking pallet is taken from there onto the driving unit.

9 Claims, 7 Drawing Sheets

MECHANICAL AUTOMOBILE PARKING FACILITY

SUMMARY OF THE INVENTION

The invention concerns a mechanical automobile parking facility, with parking pallets, whereby a vehicle drives onto an auto parking pallet and the pallet including the vehicle is placed in a selected space within the parking facility Such a mechanical automobile parking facility generally is known, e.g., the paternoster facility (elevator) where, by means of endless chains, parking pallets carrying vehicles are transported. However, this paternoster facility has serious disadvantages; among others, because of the considerable chain lengths, there are variations in the chains in order to be able to precisely set down or pick up a vehicle, and furthermore the speed of handling is very slow so that with these paternoster facilities placing and retrieving time can total an hour.

An additional mechanical automobile parking facility is known, including sliding facilities, in which roller platforms are moved in pathways on a horizontal shaft by means of a thrust unit. The parking platforms are rearranged by means of two transfer stations and lifted from the guide rails by means of a lifting device and then are moved upward into the parking space for depositing or removing, the auto. That form of device is disadvantageous because, among other things, the facility works relatively slowly, and many moving parts are present, such as cams and drives, many chains and gear wheels, so that disturbance may readily occur, and considerable wear and tear occurs.

An object of the present invention is therefore to so construct a mechanical auto parking facility of the type referred to, in the use of which a much higher speed of handling is achieved, and the workings of the parking facility run altogether safely and relatively free of wear and tear.

To overcome such problems, a driving unit on rails is provided, which moves in a parking aisle with the auto parking pallet lying thereon, wherein the auto parking pallet is pushed sideways from the driving unit by means of telescopic cylinders over slide rails into a free parking space, or conversely it is drawn from that space onto the driving unit.

The essence of the invention resides in the feature that now without chains, or sliding of the pallets behind one another, a driving unit is provided which picks up a single pallet, and moves each individual pallet to a free parking place, and by means of telescopic cylinders, slides the pallet sideways over slide rails from the driving unit into the free parking space. In similar fashion, in the removal of a private auto, the driving unit moves to the parking space and draws the pallet by means of the telescopic cylinders onto the driving unit, and the driving unit returns to the starting point, and then the vehicle leaves the driving unit.

The present system including the driving unit has the great advantage that it is very fast, and it is also absolutely safe. There are no parts that run over cams and drives; furthermore long drawn chains and sprockets are avoided so that very short placing and retrieving times can be achieved.

In a preferred form, the driving unit also has a lifting device whereby the auto parking pallet is arranged on two opposite-lying lifting platforms in connection with a locking device.

In this form, the driving unit with the lifting device allows an essentially larger parking area for private autos in the parking boxes, because in addition to a lower parking level, parking levels arranged thereabove in two, three, or four layer construction, can be driven up to with the driving unit and the lifting device.

In one design, it is provided that the lifting device is constructed in the manner of two lifting platforms between vertical carriers of the driving unit, wherein rollers arranged at the left and right sides of the lifting platform grip into the U-shape carriers, and a telescopic cylinder or lifting platform driven by a hydraulic motor is attached, wherein at the lifting platform, revolving guide chains are arranged for synchronization, which run over reverse wheels and are securely fastened at one end with the driving unit.

This special design yields an especially safe lifting device with a synchronized lifting gradient, whereby the vehicle can be lifted to different heights inside the driving unit somewhat in the manner of a forklift, in order to be pushed from there onto the pallet parking boxes.

In a further advantageous design, it is provided that inside the auto parking facility at a starting position of the driving unit, above the latter, a turntable with navigation slabs is provided with a rim bearing, wherein the turntable has an opening, inside which the auto parking pallet raised by the lifting device is latched.

This design with the turntable achieves the advantage that a vehicle can be moved from an unfavorable position to the parking facility and then turned by the turntable into the correct position for parking in the parking facility.

In this design, the auto parking system includes the drawing unit as well as the shelf box system, and furthermore the rim bearing and the turntable with navigation slabs, and further the auto parking pallets themselves.

A vehicle moves first over the navigation slabs onto the turntable, particularly onto an auto parking pallet stored there. The driver leaves his vehicle at this starting point.

The auto parking pallet holding the vehicle is now turned by means of the turntable to a position suitable for parking, and the auto parking pallet is taken from the lifting platform of the driving unit.

The driving unit then moves in a parking aisle on rails with the auto parking pallet and the vehicle standing thereon, until a free parking space is reached. Next the auto parking pallet holding the vehicle is pushed sideways into the parking space by means of telescopic cylinders, that is, over slide rails which are arranged in the pallet parking boxes.

The driving unit now takes an auto parking pallet out of a free parking surface and moves with the pallet to the starting point where a parking process can now recommence.

Should a vehicle be called for, the driving unit drives to the vehicle and takes the auto parking pallet including the vehicle, onto the driving unit and moves to the starting point, where the vehicle is lifted until the turntable is reached. By means of the turntable, the vehicle can then leave the parking facility.

In a preferred design, the telescopic cylinders, which either slide the pallet from the driving unit or take it onto the driving unit, are constructed to be double acting, wherein the pallet overlaps the telescopic cylinders at the front and tail ends with a U-shape section, and furthermore, the telescopic cylinders have at the ends thereof a locking device with bolts, whereby the bolts grip into bores inside U-shape sections of the pallet.

In this type of design, an especially safe sliding or lifting of the pallet is achieved in connection with a locking onto the driving unit.

Furthermore, it is provided that on the turntable, a four-fold magnetic latching means for the pallet by means of bolts is provided, which grip into the bores of the U-shape sections of the pallet. In this design, the pallet is held on the turntable by magnetic locking means until the driving unit with the lifting device moves the pallet up from below, and then the magnetic latching means can be released from the turntable. In being received on the driving unit, the pallet is specially latched at the lifting platform.

The latching device of the pallet on the driving unit is of magnetic character with bolts, whereby from the lifting platform, on which the pallet lies at the front and rear ends, the bolts project and grip into the bores of the pallet.

Bores are provided inside water channels of the pallet. The water channels are provided in the region of the pallet so that water can harmlessly run off from a parked vehicle by way of bores.

The driving unit has an advantageous driving mechanism by means of a hydraulic motor, wherein the driving unit has three axles, and two axles are driven by means of a driving chain.

The device includes slide rails provided in the modular dimension inside the parking spaces, which are arranged next to and behind one another in the manner of a modular system, wherein a shelf box system is constructed; and the slide rails form a check rail above in the pallet having a groove receiving the check rail providing support, and it slides on the slide rails.

In this design, in pushing the pallet out from the driving unit; the pallet slides over slide rails into a shelf box, wherein the slide rails additionally form check rails which provide securement by gripping into groove in the pallet.

With this sliding process, absolutely secure relationship is achieved because a rail works in a groove and especially because each pallet is individually pushed from the driving unit, so that errors are especially avoided, which with the known facilities are unavoidable when several pallets are pushed behind one another.

BRIEF DESCRIPTION OF THE DRAWINGS

The present invention will be better understood from the following detailed description of a preferred embodiment of the invention, in which like reference numbers refer to like parts, and in which.

DETAILED DESCRIPTION

Figure 1:
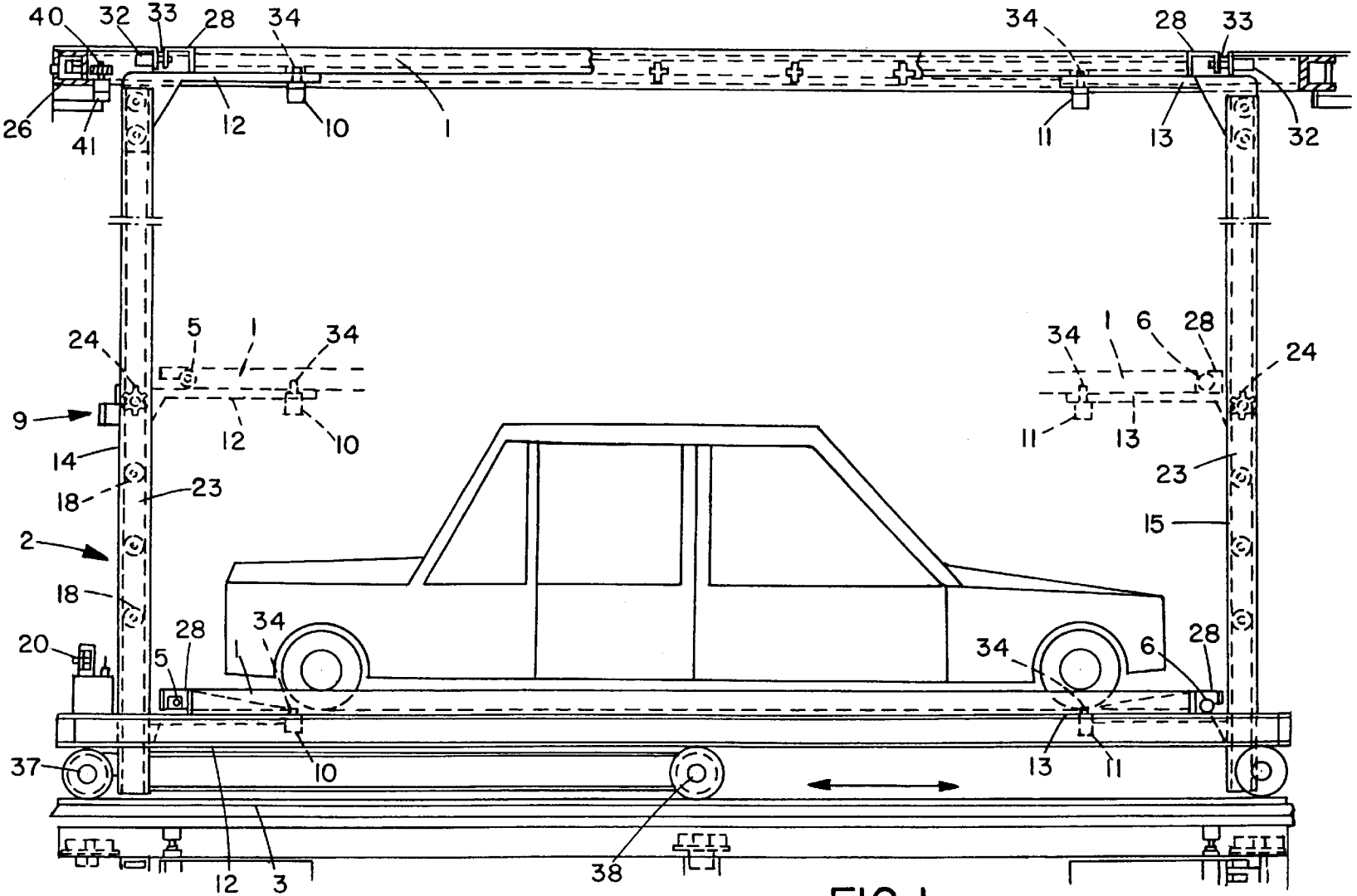
FIG. 1 is a side view of a driving unit with an auto parking pallet thereon.
Figure 2:
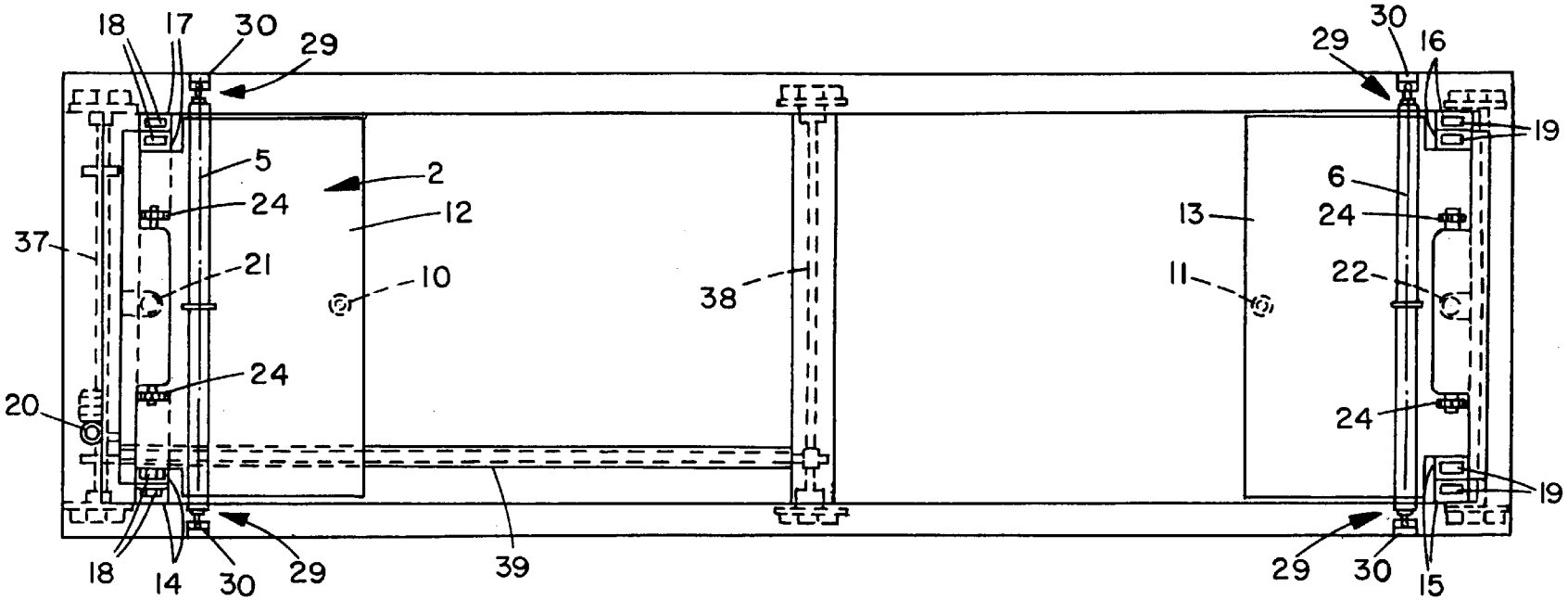
FIG. 2 is a top view of the driving unit without the pallet.
Figure 3:
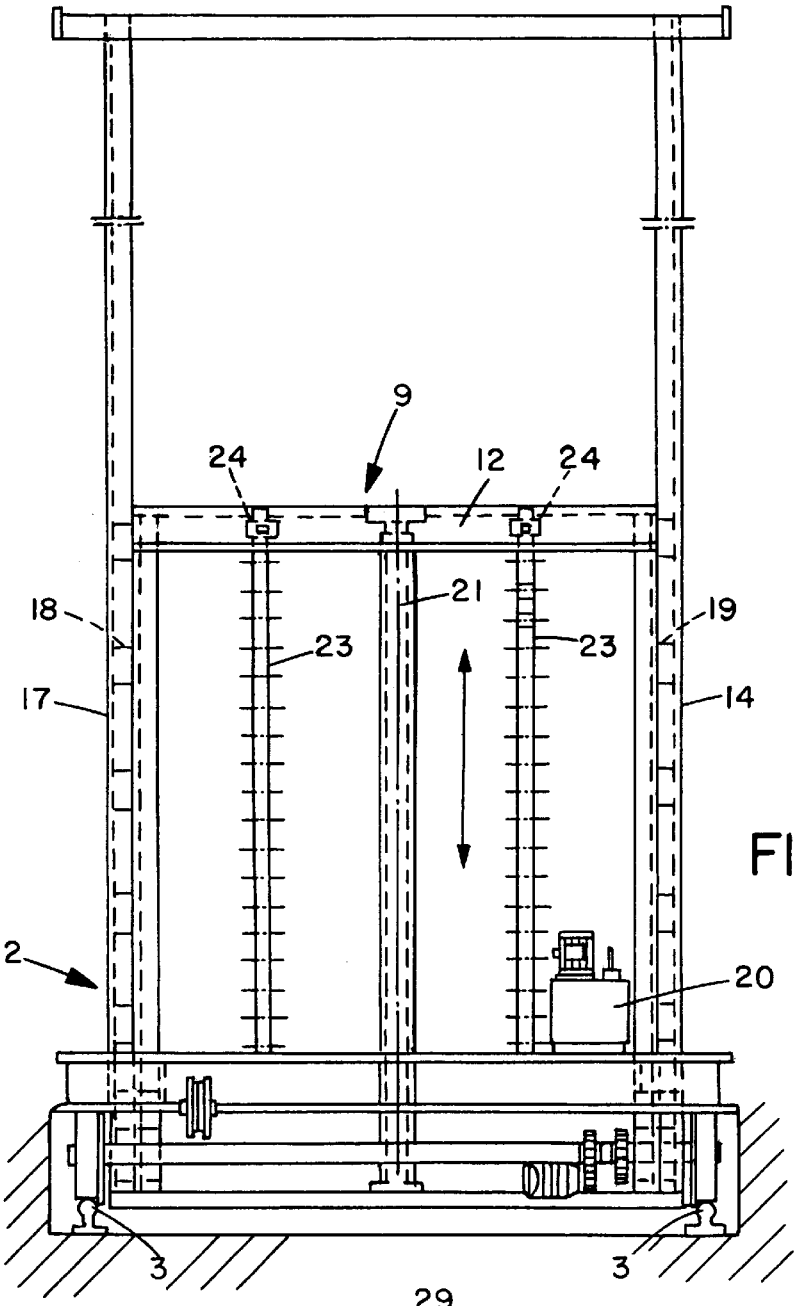
FIG. 3 is a view of the driving unit from the front showing the lifting device.

In FIGS. 1 to 3 the driving unit 2 is presented, FIG. 1 showing a motor vehicle arranged on a pallet 1, the pallet itself lying at its front and rear ends on lifting platforms 12 and 13. Magnetic latching devices 10,11 are provided at the lifting platforms 12,13 where bolts grip into bores 35 of the pallet 1 as shown in FIGS. 5 and 7.

Figure 5:
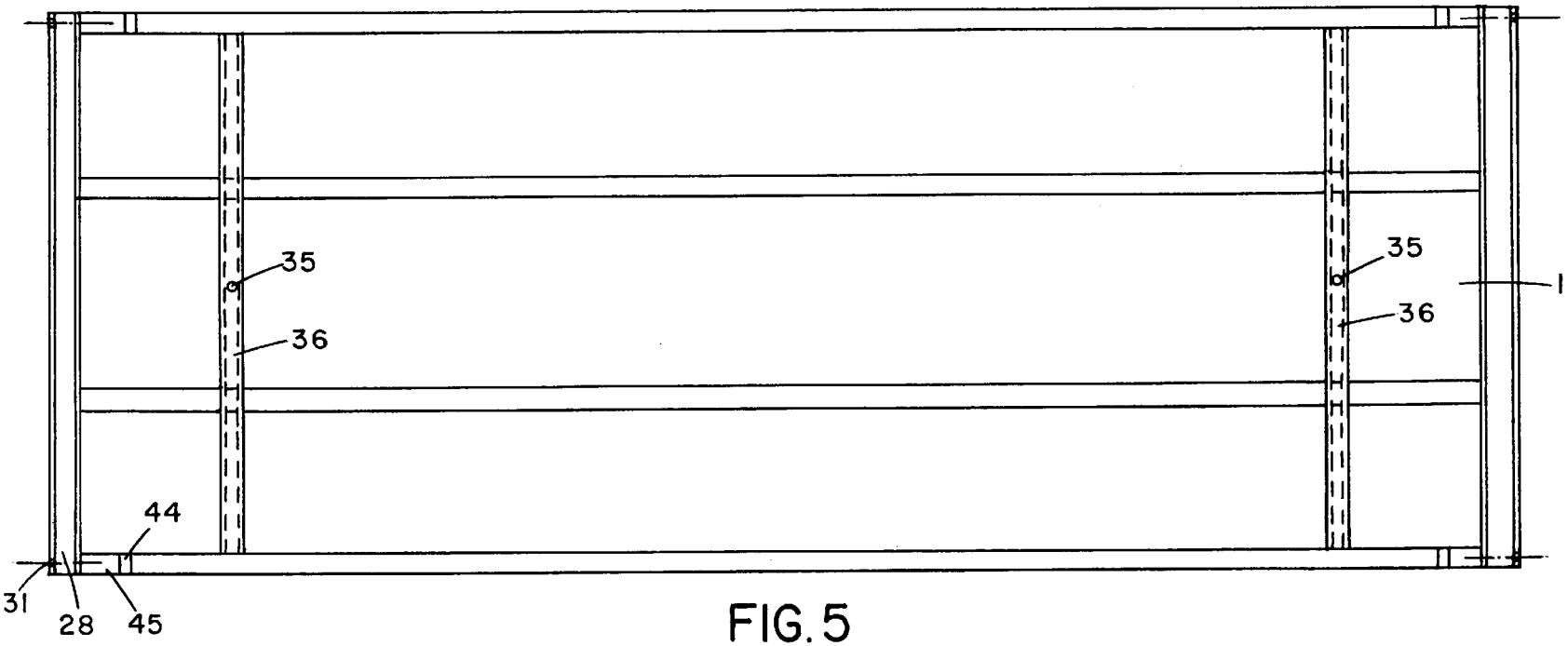
FIG. 5 shows an auto parking pallet from the underside.
Figure 6:
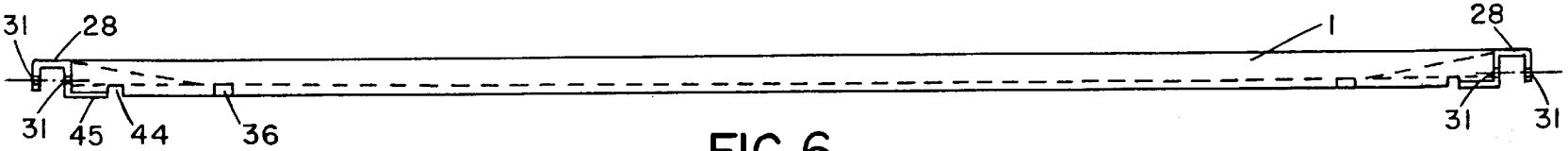
FIG. 6 shows the auto parking pallet from the side.
Figure 7:
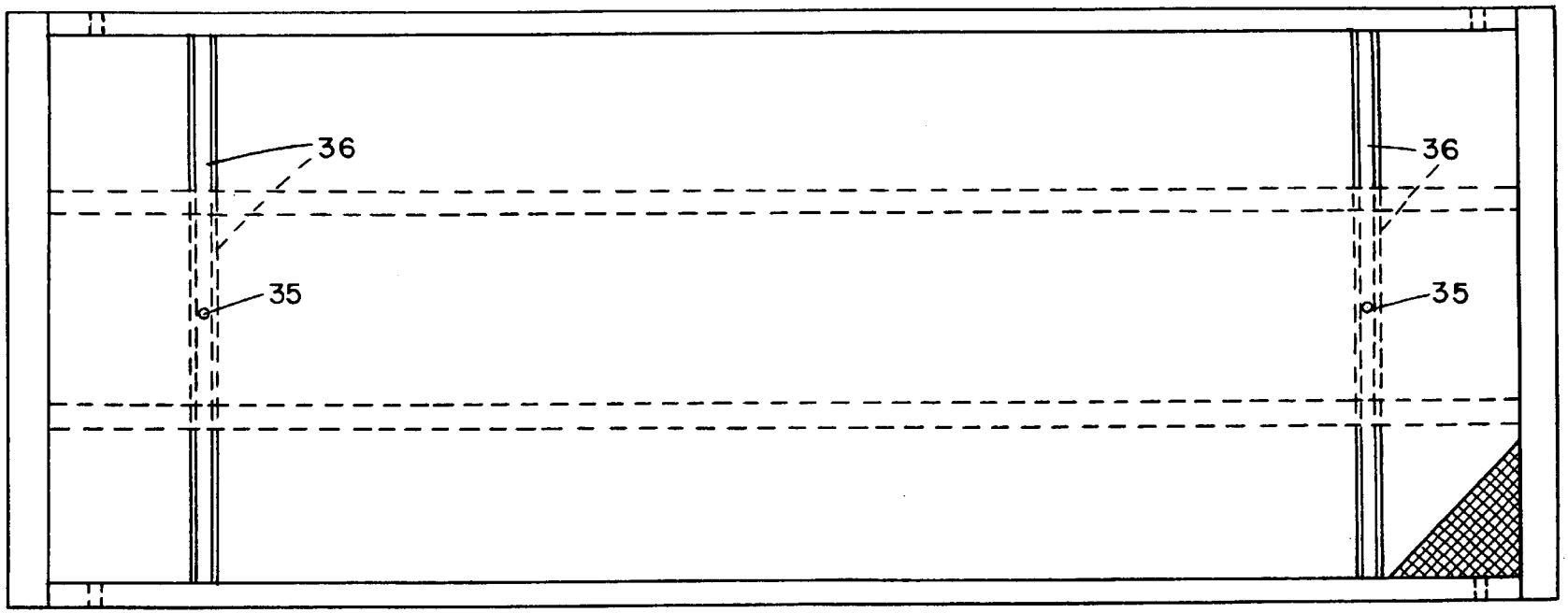
FIG. 7 shows the auto parking pallet in top view.

The pallet 1 is constructed according to FIGS. 5 to 7 and is of generally rectangular shape, having a flat upper surface for supporting a vehicle. A U-shaped channel 28 extends along each end of the pallet on its undersurface. Each channel 28 has opposite side walls through which aligned bores 31 extend at each end of the channel (see FIG. 6). A sliding block 45 extends inwardly from each channel 28 on the undersurface of the pallet. A groove or recess 44 is provided adjacent each sliding block 45, as indicated in FIGS. 5 and 6. The pallet also has a pair of water channels 36 for draining of water from the pallet. Bores 35 for receiving the bolts 34 of the magnetic latching device 10, 11 are provided in the undersurface of channels 36, as illustrated in FIG. 5. Water channels 36 are arranged so that water running from the motor vehicles can harmlessly run off through the bores 35 and the water channels 36.

Figure 4:
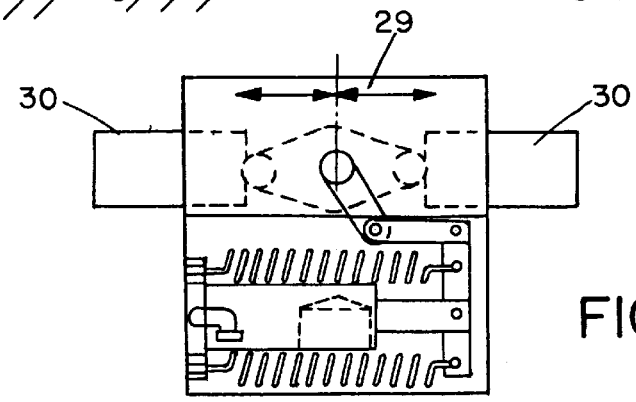
FIG. 4 shows the sliding lock for the telescopic cylinders, which is positioned at the ends of the telescopic cylinders.

FIGS. 1 and 2 further show that the pallet 1 with the U-form section 28 overlays double-acting telescopic cylinders 5,6, and as seen in FIG. 4 at the end of the telescopic cylinders 5,6, a magnetic locking device 29 is provided with bolts 30. As illustrated in FIG. 1, the downwardly facing, U-shaped channels 28 engage over double acting telescopic cylinders 5,6 mounted on the driving unit 2 (see FIG. 2) when the pallet is positioned on the driving unit, and the pallet is releasably secured to the cylinders by means of the magnetic locking device 29. Locking device 29 has two hydraulically operated bolts 30 (FIG. 4) which cooperate with two corresponding holes 31 located at the ends of the pallet in the sides of channels 36. The double acting telescopic cylinders act to drive the pallet either to the left or to the right as viewed in FIG. 2 in order to move it into a parking space. As best illustrated in FIG. 2, a pair of oppositely directed hydraulic cylinders are provided at each end of the driving unit 2 beneath a parking pallet. Depending on which direction the pallet has to be moved, the locking device of the hydraulic cylinder at the left hand or the right hand side is actuated to extend its bolt 30 into the respective hole 31 which is provided at the left and right hand end of the channels 28, as illustrated in FIG. 5. The piston of the respective hydraulic cylinder is then extended, thereby pushing the pallet into the desired parking space. After the pallet has entered the parking space, the locks 29 are released so that the extended pistons can be retracted into the respective cylinders in the driving unit.

Figure 8:
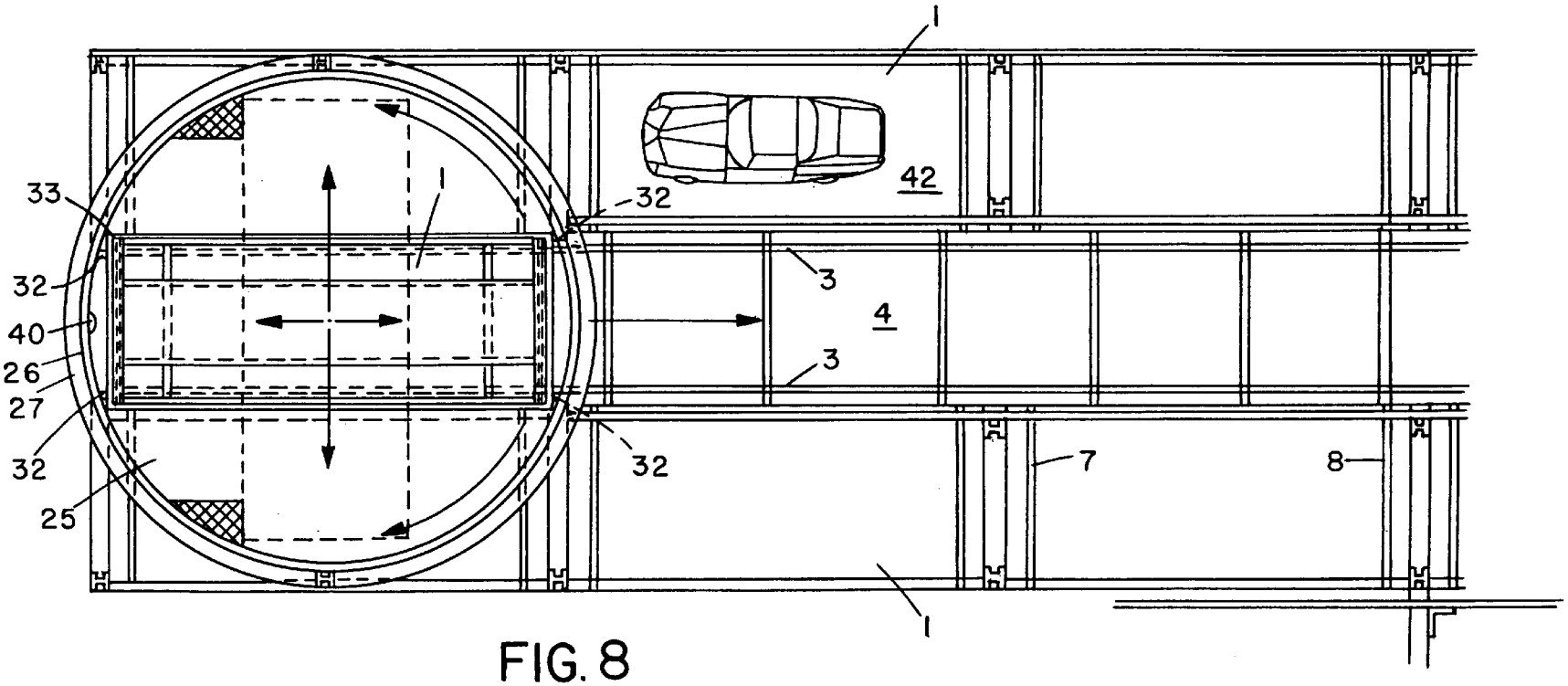
FIG. 8 is a view of the parking system unit turntable and rim bearing, with a pallet thereon, showing the roadway for the driving unit and shelf boxes in a top view.
Figure 9:
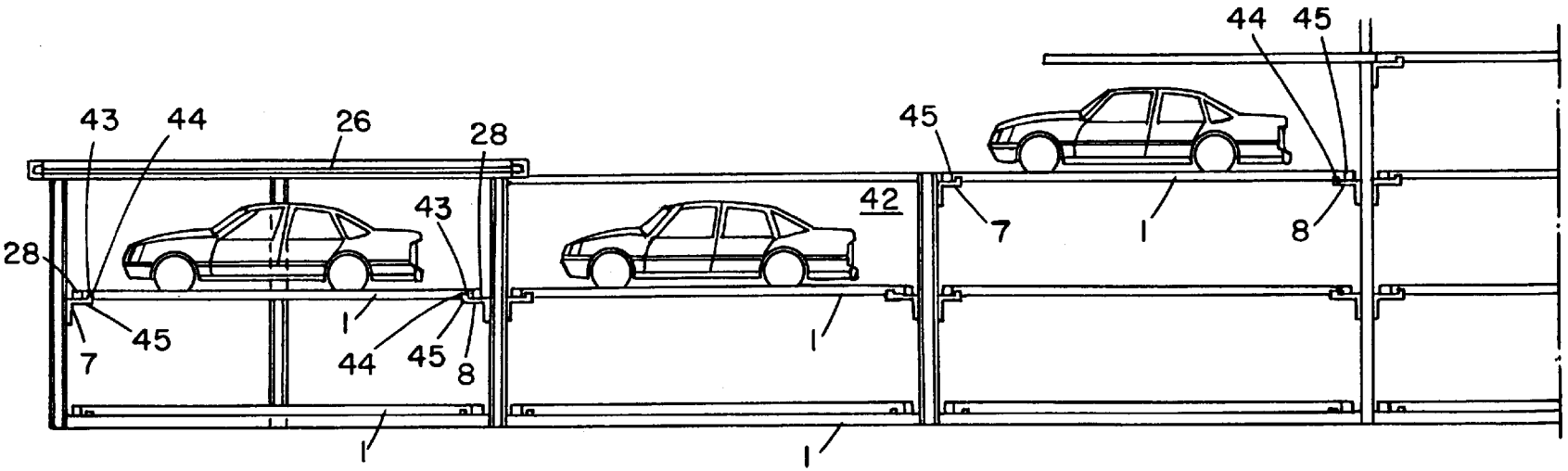
FIG. 9 shows the parking system of FIG. 8 in side view, with a shelf box system having levels at different heights.

FIG. 8 is a top plan view of a level of a parking structure, while FIG. 9 illustrates several parking levels. As illustrated in FIG. 1 and 8, a turntable 25 is arranged above an entrance position for the parking structure. FIG. 1 illustrates a driving unit 2 carrying a parking pallet positioned beneath turntable 25. The pallet can be raised by a lifting device into an opening 27 in the turntable 25, and is releasably latched in the opening by means of four magnetic locking components 32, whereby bolts 33 grip into the U-shape channels 28, that is, into the bores 31 according to FIG. 6.

From the above presentation of FIG. 1, it can also be seen that first the pallet 1 is latched with the magnetic latching device 10,11 at the lifting platform 12,13, whereby in order to be able to lower the pallet 1 out of the raised position (upper part of FIG. 1), the magnetic latching device 32 of the turntable 25 opens and then the pallet with a vehicle positioned thereon is lowered by the lifting platform 12,13 by means of the lifting device 9, as represented in FIG. 1.

The lifting device 9 is, as shown in FIGS. 2 and 3, slidably guided on four vertical carriers or guide rails 14, 15, 16, and 17 at the four corners of the lifting device. The carriers are each of U-shaped horizontal cross-section, as best illustrated in FIG. 2, and rollers 18, 19 at the ends of the lifting platforms engage and run in the guide rails or carriers. The lifting device 9 is driven by a hydraulic motor 20, itself driven by an electric motor, whereby according to FIG. 2, telescopic cylinders 21,22 of the lifting platforms 12,13 are extended and, acting through reversing wheels 24 and driving chains 23, produce synchronization of the different parts of the lifting device 9.

The driving unit 2 itself runs, according to FIGS. 1 and 3, on rails 3. The driving unit is constructed with three pairs of wheels on respective axles (see FIG. 2), and two of the axles 37,38 are driven by means of the hydraulic motor 20 acting through a chain 39.

In the upper part of FIG. 1 is a pinion 40 for driving the turntable (FIG. 8). A turntable drive unit or motor 41 acts on the pinion 40, and thereby the pinion grips into a rim bearing 26 according to FIG. 9.

In FIG. 1, inside the driving unit 2, the various locations of the pallet 1 on the lifting platforms 12,13, are schematically indicated, whereby the pallet 1 is moved from a raised position by means of the lifting device into a lowered position, and then the driving unit 2, including the pallet 1 and the vehicle lying thereon, moves in the roadway 4 according to FIG. 8.

In FIG. 2 the telescopic cylinders 5,6 are especially evident, with the projecting locks 29 over the bolts 30, whereby by means of these locks 29 the pallet 1 is thrust from the driving unit 2 into a free parking space 42 (FIG. 9), or the pallet 1 in reverse movement is taken from the parking space 42 onto the driving unit by means of the lock 29.

The arrangement and sliding of the pallet 1 is evident from FIG. 9 where it can be seen that the pallet 1 is supported on slide rails 7,8. The slide rails 7,8 have upwardly projecting guides 43, received in grooves 44 in the pallet. In reverse manner the pallet is taken from the parking space 42 onto the passing driving unit 2, and the supports 45 (FIG. 6) slide along on the slide rails 7,8, (FIG. 9) and in this case also the pallet 1 is moved on the slide rails 7,8. In all cases where the pallet 1 is on the driving unit 2, the pallet is latched by means of the lock 10 (FIG. 1) with bolts 34 in the bores 35 according to FIGS. 5 and 7.

As a specific form, the pallet 1 as shown more in detail in the FIGS. 5,6,7, includes a framework construction, in which at the ends of the pallet, U-shape channels or grooves 28 are arranged. The channels have bores 31 which engage with the locking devices of the double acting hydraulic cylinders to move the pallet on or off the driving unit 2, i.e. out of or into a parking space, or with the magnetic latch means 32 (see FIG. 8) in order to secure the pallet in the opening of the turntable.

According to FIG. 6 the sliding blocks 45 are additionally provided, providing a support, and the pallet groove shaped recesses 44, in order to securely guide the pallet 1 when being pushed into the parking space.

As viewed in FIG. 5 it will be seen that on the opposite sides of the pallet, on the underside, water channels 36 are constructed so that water that might fall on the vehicle can harmlessly run off, especially over the bores 35.

In FIG. 8 the turntable 25 with a latched pallet 1 is presented in connection with a parking aisle 4 and laterally arranged rails 3, wherein by means of the driving unit 2, (FIG. 1), the pallet is shoved into a free parking space 42 (FIGS. 8 and 9).

The turntable 25 has on the upper side an opening 27 into which the pallet 1 moves and is locked there by means of the magnetic latch 32 whereby by means of the pinion 40 the turntable 25 can be moved on the rim bearing 26. In this manner the pallet 1 can advantageously be turned for an arrival or a departure, whereby the turntable facilitates arrival and departure of the vehicles.

The shelf box system presented in FIGS. 8 and 9 consists of four double T carriers, of differing heights. At the surfaces of these carriers are welded angles or slide rails 7,8 which in the modular dimension are 1500 mm to 1900 mm wide. On the support side of the pallet, there is a support 45, which serves as a sliding block or pallet guide. The carrier elements of the shelf boxes are screwed front and back at the bottom to another carrier, whereby at the dead floor (insert) side of the shelf box, this carrier serves as an opposite surface for the driving unit and at the same time increases security.

The pallet deposit boxes or parking spaces according to FIGS. 8 and 9 are always of like size, screwed and welded together in the modular system. The maximum construction height is in this case 9700 mm high, that is, six stories, which is the largest construction height. The length of the facility is however variable by a building unit of 5750 mm, which can be constructed two to six stories high.

The driving unit 2 drives between the shelf boxes on rails 3 (FIG. 8). The driving unit in this case corresponds to the width of the pallets, in which the distance between the individual boxes and the driving unit to the left and the right, amounts to 40 mm, which serves for greater security. The delivery or play between box and driving unit 2 and vice versa is thus minimal, which ensures greater security.

The parking system consists thus of three units: left and right the parking boxes, and in the middle the driving unit with various lengths and heights. According to FIG. 8, in the region of the parking system, the rim bearing 26 is mounted with an inner diameter of around 6000 mm, this rim bearing 26 being provided with navigation platforms. In the turning interior part of the rim bearing, a channel section is screwed, which is formed as a bent steering rack and forms the rim bearing 26. The surface of the turntable 25 is covered with a bottom plate, in which in the middle, a recess 27 is formed with an angle iron frame, into which recess 27 the auto parking pallets 1 are easily inserted, which takes place from below by means of the driving unit 2. The auto parking pallet 1 is furthermore held at the turntable 25 by means of magnetic latching units 32, whereby here the same locking holes 31 are used, in order to push the parking pallets 1 with the telescopic cylinders 5,6 into the parking boxes, or in reverse order, to move these onto the driving unit 2.

The operation of the automobile parking facility is as follows:

The auto is driven forward into the garage onto the turntable 25, and the driver steps out and away from the vehicle. As soon as the driver has left the turntable 25, through the release of an activating switch not shown, the turntable is set in motion, turning 90 or 180 degrees in direction of the parking boxes. From below, the lifting platforms of the driving unit 2 ride to the floor area of the auto parking pallet 1 and lock these with two locking units 10,11 (FIG. 1) into the holes 35 provided which are located in the water channels 36 of the pallet. After this step, the magnetic latch means 32 in the rim bearing 26 unlocks and the auto can be moved to its parking place or parking box with the driving unit 2, after the lowering process of the lifting device 9. The departure is conducted in reverse order. The turntable 25 is turned 360 degrees, so that each vehicle is advantageously always moved forward.

The driving unit 2 consists of a frame construction of U-beams with six gauge wheels, whereby the rear ones are connected with each other and driven by a shaft, and the two middle wheels are connected with the drive by means of a chain 39. A lifting mount is positioned both left and right on the frame of the driving unit 2, consisting of section rails with built-in ball bearing spacing rollers. The interior part with a support in the lifting mount for the auto parking pallet is a platform, which is raised to different lifting heights by means of hydraulic cylinders 21,22 and by means of tension chains for synchronization. By means of a built-in fuel distributor (flow divider) with alignment, an exact synchronization is achieved. On the platforms 12,13, on both the left and the right, are mounted bilaterally telescoping cylinders 5,6 (FIG. 2) which can press as well as pull, double acting in connection with a synchronization control. At each end of the cylinder 5,6 is a lock 29, which locks hydraulically on contact with the auto parking pallet 1 by means of two bolts 30 into the holes 31, in order to move the auto into the parking box or to remove it therefrom. The pushing step can however only be conducted if the locks 29 have opened, with which auto parking pallet 1 is secured on the driving unit 2, this automatically occurring by means of control by the proximity switches which are arranged left and right on each parking box. Similarly proximity switches are arranged left and right on the driving unit, in order to automatically release a signal that the correct parking box had been reached.

The telescopic cylinders 5,6 are capable of moving the parking pallet sideways from the drive unit over slide rails 7,8 into a parking space on the left or right hand side of the drive unit, and of retrieving a parking pallet from a parking space and moving it back onto the driving unit 2. While the pallet is on the driving unit, it is locked in place by means of lock 10 having bolts 34 which extend into the bores 35, as indicated in FIGS. 1,5 and 7.

The telescoping cylinders are double acting, and can press as well as pull the pallet to and from its parking position. At each end of the cylinders 5,6 is a lock 29 having hydraulically operable bolts 30 (FIG. 4) which co-operate with two corresponding holes 31 located in the channels 28 at opposite ends of the pallet. Depending on which way the pallet has to be moved, i.e. either to the left or the right as viewed in FIG. 8, the bolts 30 engage with the holes 31 either at the left or right hand end of the respective channels 28. The bolts 34 are released from bores 35, and the hydraulic cylinders 5,6 extend telescopically to push the pallet into the desired parking space. After the pallet has entered the parking space, the locks 29 are released so that the telescopic cylinders can be retracted into the driving unit.

A pallet can be removed from a parking space in a similar manner. The driving unit is moved into position in front of the desired parking space, and the hydraulic cylinders are extended into the respective channels 28 of the pallet. The locks are actuated to extend bolts 30 into the holes 31, and the cylinders are retracted, thereby pulling the pallet out of the parking space and onto the driving unit. The locks 29 disengage, and the lock 10 is operated to secure the pallet onto the driving unit.

On the driving unit 2 itself the hydraulic pumping set 20 is mounted, by means of which all functions operate. The actuation of the driving unit 2 occurs by means of a hydro motor with brakes. The pump drive occurs electrically. A cable uptake drum is mounted at the under carriage. All of the command modules are equipped with electromagnetic valves, which are controlled by electrical impulses.

The retrieval of a motor vehicle by means of the auto parking pallet occurs as follows:

On request, the corresponding auto is retrieved out of the parking box, pulled onto the driving unit 2 and automatically locked by means of the locks 10,11 (FIG. 1). Then the driving unit 2 is driven to the turntable 25 and raised to the awaiting opening 27, and the pallet locks itself now automatically by means of the magnetic latch 32 on all four points (FIG. 1). After this has occurred, the lock 10,11 unlocks itself between the lifting platform 12,13 and the pallet 1, and the driving unit or lifting platforms 12,13 are lowered about 40 mm out of the turntable 25.

Now the turntable 25 can be turned in the desired direction, and the auto can be driven off. All of the processes are computer operated, either by means of punch cards or a cryptographic system.

The speed of parking or removal amounts to about 2.2 mm per second, that is, for example, in a facility with 40 autos, a parking or removal time of 50 seconds.

The smallest facility is intended for private use in an apartment building or backyard for approximately eight private autos, whereby two story systems 3.2 m high, 6.4 m wide, 11.8 m long are used and thereby a parking or retrieving time of 38 seconds can be achieved.

With the modular construction system, any desired parking lot length or height can be achieved. In this manner a 100 m lane is no problem with a system width of 6.4 m. Of course in a parking garage, two, three or four such systems can be installed next to each other in order to increase the holding capacity.

For example, such a parking system can be made with 6.4 m width, 41 m length, and 9.4 m height, where 149 autos can be installed. On two lanes of 13 m width, this is 296 autos, that is, on a 533 $m^2$ surface, 296 private autos can be parked, completely thief and damage proof.

The turntable 25 with access can be mounted in any location of the structure, that is, just as well in the front, rear or in the middle. The turntable can also be installed outside of the building, whereby above it only a garage passage must be arranged with automatic doors with a measurement of 6.5×6.5 m area and a room height of 2.3 m.

For operation, the entire parking facility needs only two electric motors, that is, a small transmission braking motor 41 to serve the turning process and another electric motor for the hydraulic facility, so that the maintenance and operating costs are small. Also the other parts, for example, the travelling mechanism of the hydraulic brake motor is maintenance free, likewise the hydraulic cylinder and a proximity switch, so that in a maintenance free facility, a secure and wear and tear free parking operation can be conducted.

What is claimed is:

1. A mechanical vehicle parking facility, comprising:

a parking structure having at least one parking level, the parking level having an aisle extending in a first, longitudinal direction and having opposite sides, and a plurality of parking spaces extending along opposite sides of the aisle;

a running rail extending along each side of the aisle;

each parking space having opposite ends, and having a slide rail at each end of the space extending in a second direction transverse to said longitudinal direction;

a plurality of vehicle parking pallets, each parking pallet being capable of having a vehicle driven onto it and having support means for supporting a vehicle thereon;

a driving unit capable of supporting a parking pallet with a vehicle thereon;

the driving unit being movable on said running rails along said aisle;

the driving unit including hydraulic telescopic cylinders for moving a parking pallet in a direction transverse to said first direction from the driving unit into an adjacent parking space on said slide rails, and in a reverse direction from said parking space onto said driving unit;

said slide rails supporting a parking pallet and vehicle in a respective parking space;

the driving unit having a lifting platform assembly for supporting a parking pallet, the lifting platform assembly including locking means for locking the parking pallet onto the driving unit, and a lifting device for lifting the platform assembly with the parking pallet and vehicle thereon;

the parking structure having an entrance position for entry of vehicles into the facility;

a turntable arranged above the entrance position of said structure, the turntable including a rotary drive device for rotating the turntable; and the turntable having an opening for receiving a parking pallet with a vehicle thereon in response to the pallet being raised by the lifting device, and a releasable locking device for releasably locking the parking pallet in said opening, whereby the parking pallet and vehicle can be rotated into a selected orientation for driving into or out of the parking facility.

2. The facility as claimed in claim 1, wherein the parking structure has a plurality of levels, and each level has at least one aisle and a plurality of parking spaces along said aisle.

3. The facility as claimed in claim 1, wherein the lifting device comprises vertical carriers of U-shaped cross-section, the lifting platform assembly having rollers riding in the U-shaped carriers, and telescopic cylinder drive means for moving a supported pallet in a vertical direction.

4. The facility as claimed in claim 1, wherein each pallet has an upper surface for supporting a vehicle and a lower surface, and opposite ends, the pallet further having a downwardly directed, U-shaped channel on its lower surface adjacent each end of the pallet, and a respective hydraulic telescoping cylinder is arranged in each U-shaped channel when the pallet is supported on the driving unit, each telescoping cylinder having a locking bolt for extending transversely of the cylinder, each U-shaped channel having opposite sides and holes along at least one side, and said locking bolts being releasably engageable in a selected hole in the side of the respective channel.

5. The facility as claimed in claim 4, wherein the turntable has four magnetic locks arranged for releasable engagement in the holes in said pallet channels.

6. The facility as claimed in claim 1, wherein each pallet has at least two water drainage channels for draining water from the pallet.

7. The facility as claimed in claim 1, wherein the locking means for locking a pallet onto the driving unit comprises magnetic bolts, each pallet having holes for alignment with said bolts, and said bolts being movable into an extended position in said holes to lock the pallet on said driving unit.

8. The facility as claimed in claim 1, wherein the driving unit has drive means including a hydraulic motor, three axles, and a drive chain, the drive chain drivably interconnecting two of the axles, and the drive means is operable through the drive chain for driving said two axles and thereby said driving unit.

9. The facility as claimed in claim 1, wherein each pallet has a pair of spaced grooves for engagement on said slide rails at opposite ends of a respective parking space when said pallet is driven into said space.

* * * * *